US008975548B2

(12) United States Patent
Dahm et al.

(10) Patent No.: US 8,975,548 B2
(45) Date of Patent: Mar. 10, 2015

(54) RETAINING STRUCTURE FOR MAINTAINING FACTORY SETTINGS OF GANG-STYLE LINKAGE FOR HIGH VOLTAGE DEAD TANK BREAKER WHILE OPERATING MECHANISM IS REMOVED

(71) Applicant: ABB Technology AG, Zurich (CH)

(72) Inventors: Beth Dahm, Pittsburgh, PA (US); Matthew Cuppett, Uniontown, PA (US); Jonathan Fuge, Farmington, PA (US)

(73) Assignee: ABB Technology AG, Zürich (CH)

( * ) Notice: Subject to any disclaimer, the term of this patent is extended or adjusted under 35 U.S.C. 154(b) by 183 days.

(21) Appl. No.: 13/856,453

(22) Filed: Apr. 4, 2013

(65) Prior Publication Data

US 2013/0270083 A1 Oct. 17, 2013

Related U.S. Application Data

(60) Provisional application No. 61/623,601, filed on Apr. 13, 2012.

(51) Int. Cl.

| | |
|---|---|
| ***H01H 5/00*** | (2006.01) |
| ***H01H 3/46*** | (2006.01) |
| ***H01H 33/02*** | (2006.01) |
| ***H01H 33/42*** | (2006.01) |

(52) U.S. Cl.

CPC ..... *H01H 3/46* (2013.01); *H01H 33/022* (2013.01); *H01H 33/42* (2013.01)

USPC ..... 200/400

(58) Field of Classification Search

USPC ..... 200/337, 48 R, 49, 318, 321, 400, 82 B; 218/7, 140, 153, 154; 335/21, 36; 337/70

See application file for complete search history.

(56) References Cited

U.S. PATENT DOCUMENTS 2,261,711 A 11/1941 Behringer
3,597,556 A * 8/1971 Sharp et al. ..... 218/4

(Continued)

FOREIGN PATENT DOCUMENTS

JP H0364815 A 3/1991
JP H0963423 A 3/1997

OTHER PUBLICATIONS

PCT Search Report & Written Opinion in PCT/US2013/035189 dated Jul. 11, 2013.

*Primary Examiner* — Vanessa Girardi
(74) *Attorney, Agent, or Firm* — Manelli Selter PLLC; Edward J. Stemberger

(57) ABSTRACT

Linkage structure is connected between an operating mechanism and an actuating assembly of a circuit breaker for opening and closing an electrical contact of a pole assembly. The linkage assembly includes a lever to connect with the actuating assembly. A connection rod is coupled to one end of the lever and is associated with a close spring for closing the electrical contact. A spring structure is coupled to another end of the lever. The spring structure includes an open spring providing a spring force on the lever for opening the electrical contact. The open spring places the connection rod in tension. Retaining structure is associated with the lever and the spring structure to ensure that the spring force of the open spring, exerted on the lever, is directed to the retaining structure so that tension on the connection rod is removed, enabling the connection rod to be serviced.

13 Claims, 2 Drawing Sheets

(56) References Cited

U.S. PATENT DOCUMENTS

| | | | | |
|---|---|---|---|---|
| 4,135,072 | A * | 1/1979 | Maier et al. | 200/308 |
| 4,713,508 | A * | 12/1987 | Baginski et al. | 200/568 |
| 4,996,397 | A * | 2/1991 | Kuhn et al. | 218/120 |
| 2006/0131154 | A1 * | 6/2006 | Fitzer et al. | 200/400 |
| 2008/0116049 | A1 | 5/2008 | Schafer | |

* cited by examiner

RETAINING STRUCTURE FOR MAINTAINING FACTORY SETTINGS OF GANG-STYLE LINKAGE FOR HIGH VOLTAGE DEAD TANK BREAKER WHILE OPERATING MECHANISM IS REMOVED

FIELD

The invention relates to high voltage, dead tank circuit breakers and, more particularly, to structure for maintaining the factory pretension of a spring and thus linkage when an operating mechanism is removed from the breaker.

BACKGROUND

Circuit breakers are commonly found in substations and are operable to selectively open and close electrical connections. Typical dead tank circuit breakers have pole assemblies that include first and second electrical conductors in associated bushings. As is known in the art, electrical power lines are coupled to first and second electrical conductors, and the circuit breaker selectively opens or closes the electrical connection there-between. A bell crank or other actuating assembly is associated with a respective pole assembly. The bell cranks are interconnected by a gang-style linkage so that all three poles assemblies are actuated at the same time by a single operating mechanism.

In shipping the circuit breaker to its installation location, it is desirable to remove the operating mechanism from the linkage so that the breaker can be shipped one truck. On such spring-open, spring-close driven circuit breakers, the pretension setting of a stand-alone open spring must be removed prior to removing the operating mechanism. This eliminates forces on a linkage which could injure the worker when removing the operating mechanism for shipping or servicing. However, when the operating mechanism is reattached, the factory pretension spring setting on the linkage is lost.

There is a need to provide structure to maintain factory spring pretension on a linkage of a circuit breaker when the operating mechanism is removed from the breaker.

SUMMARY

An object of the invention is to fulfill the need referred to above. In accordance with the principles of the present invention, this objective is obtained by providing linkage structure for connection between an operating mechanism and at least one actuating assembly of a circuit breaker for opening and closing an electrical contact of a pole assembly associated with the actuating assembly. The linkage structure includes at least one lever constructed and arranged to connect with the at least one actuating assembly. At least one connection rod is coupled to lever and is associated with a close spring for closing the electrical contact. At least one spring structure is coupled to the lever and is constructed and arranged to open the electrical contact. The spring structure includes an open spring providing a spring force on the lever for opening the electrical contact. The open spring places the connection rod in tension. At least one retaining structure is associated with the lever and the spring structure and is constructed and arranged to ensure that the spring force of the open spring, exerted on the lever, is directed to the retaining structure so that tension on the connection rod is removed, enabling the connection rod to be serviced.

In accordance with another aspect of the disclosed embodiment, a method maintains pretension on linkage structure connected between an operating mechanism and at least one actuating assembly of a circuit breaker. The linkage structure includes at least one lever constructed and arranged to connect with the at least one actuating assembly for opening and closing an electrical contact of a pole assembly associated with the actuating assembly, at least one connection rod coupled to the lever and associated with a close spring for closing the electrical contact, and at least one spring structure coupled to the lever. The spring structure includes an open spring providing a spring force on the lever for opening the electrical contact. The open spring places the connection rod in tension. The method associates retaining structure with the lever and the spring structure. The retaining structure is adjusted to ensure that the spring force of the open spring, exerted on the lever, is directed to the retaining structure so that tension on the connection rod is removed, enabling the connection rod to be serviced. After servicing the connection rod, the retaining structure is further adjusted to redirect the spring force from the retaining structure back to the lever.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXEMPLARY EMBODIMENT

Figure 1:
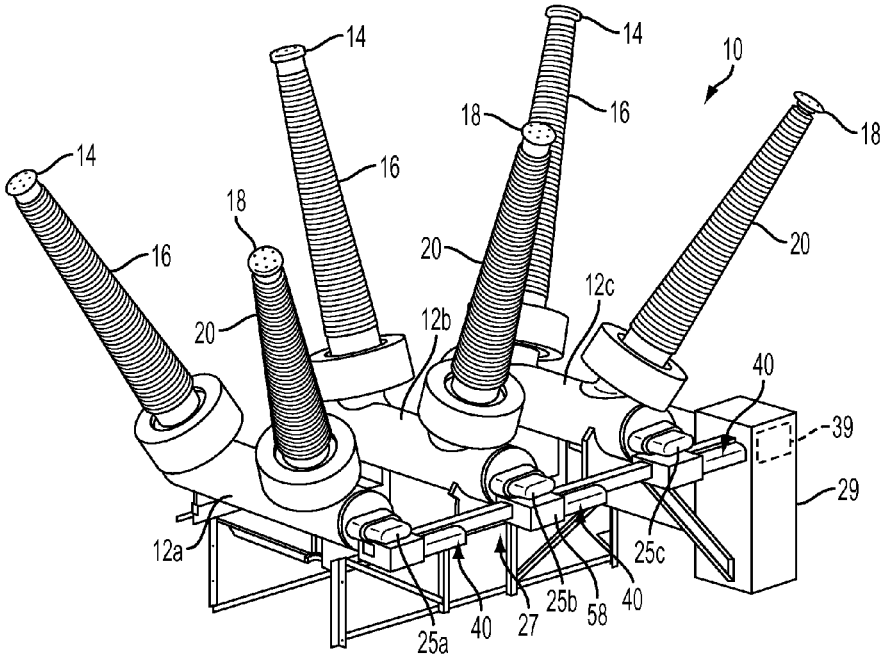
FIG. 1 is a front view of a high voltage, three pole operated dead tank circuit breaker having an interphase linkage structure in accordance with an embodiment.

With reference to FIG. 1, a circuit breaker is shown, generally indicated at 10. Circuit breaker 10 is a three phase circuit breaker, and thus includes three pole assemblies 12*a*, 12*b* and 12*c*. Each pole assembly 12 includes a first electrical conductor 14 carried in a first bushing 16 and a second electrical conductor 18 carried in a second bushing 20. Electrical power lines are coupled to the first and second electrical conductors 14 and 18, and the circuit breaker 10 selectively opens or closes the electrical connection there-between.

Figure 2:
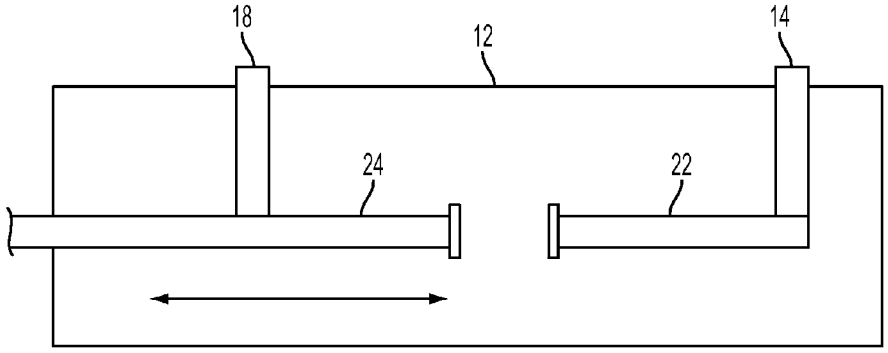
FIG. 2 is a schematic view of an interior of a breaker pole of the circuit breaker of FIG. 1, wherein the electrical contacts are open.

With reference to FIG. 2, a simplified view of an interior of pole assembly 12 is shown, wherein first electrical conductor 14 is electrically connected to a stationary contact 22 which is immovably secured within pole assembly 12. Second electrical conductor 18 is electrically connected to a movable contact 24 which is carried within pole assembly 12 in a manner allowing longitudinal movement therein. Thus, in a first position, the movable contact 24 may be positioned to break the electrical connection between first the electrical conductor 14 and second electrical conductor 18 (FIG. 2). In a second position, the movable contact 24 may be brought into contact with stationary contact 22 to electrically connect the first electrical conductor 14 and the second electrical conductor 18. The interior space of pole assemblies 12 are sealed and generally adapted to minimize arcing between stationary contact 22 and movable contact 24. The interior volume of pole assembly 12 may be filled with dielectric mediums that include SF6, dry air, dry nitrogen, CO2 or oil. Alternatively, a vacuum-type interrupter could be employed within the tank volume surrounded by dielectric mediums mentioned.

Returning to FIG. 1, an actuating assembly, preferably in the form of a bell crank assembly 25*a*, 25*b*, 25*c*, is coupled with the movable electrical contact 24 of a respective pole assembly 12*a*, 12*b* and 12*c* for opening and closing the electrical connection between electrical conductors 14 and 18. The bell crank assemblies are conventional and can be of the type disclosed in U.S. Publication No. 20100270136 A1, the content of which is hereby incorporated by reference into this specification. The bell crank assemblies are interconnected by a gang-style, non-rotary linkage structure, generally indicated at 27, so that all three poles assemblies are actuated at the same time by a single, electrically controlled operating mechanism 29.

Figure 3:
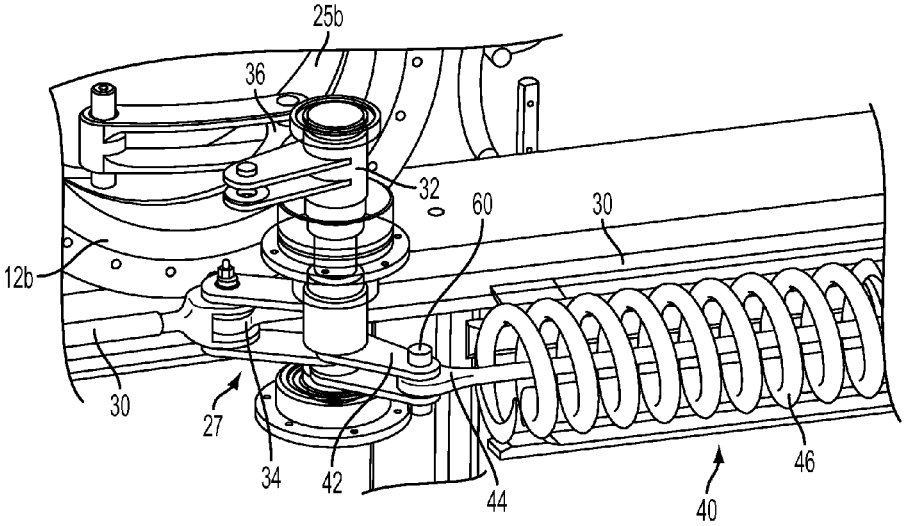
FIG. 3 is an enlarged side view of a portion of the linkage structure associated with a pole assembly, with a lever, an open spring, and interphase connection rods.

With reference to FIG. 3, the linkage structure 27 includes at least one pull-pull interphase connecting rod 30 and a lever 32 coupled to one end 34 of a connection rod 30. The other end (not shown) of the connection rod 30 is coupled to another lever 32 (not shown) at another bell crank assembly. Thus, for three pole circuit breaker, three levers 32 are provided, interconnected by two connection rods 30. Each lever 32 is connected to linkage 36 of the associated bell crank assembly (e.g., 25*b*) for opening and closing the electrical connection at the associated pole assembly (e.g., 12*b*). The connecting rods 30, interconnected via the levers 32, are coupled to a conventional close spring 39 (FIG. 1) in the operating mechanism 29 for closing the circuit breaker 10. Each connecting rod 30 is coupled to an open spring structure, generally indicated at 40, via end 42 of the lever 32 that is coupled to a link 44 of the spring structure 40. The other end of the link 44 is coupled to an end of an open spring 46. The open springs 46 provide the force opposing the close spring 39 for opening the electrical connections of the circuit breaker 10. Spring 46 of the spring structure 40 also provides a spring force on the associated lever 32 and thus keeps the connecting rods 30 in tension. In the embodiment, three spring structures 40 are provided, one for each pole assembly 12. However, instead of providing three separate open spring structures 40, a single open spring 46 can be provided, for example, at pole assembly 12*a*.

Figure 4:
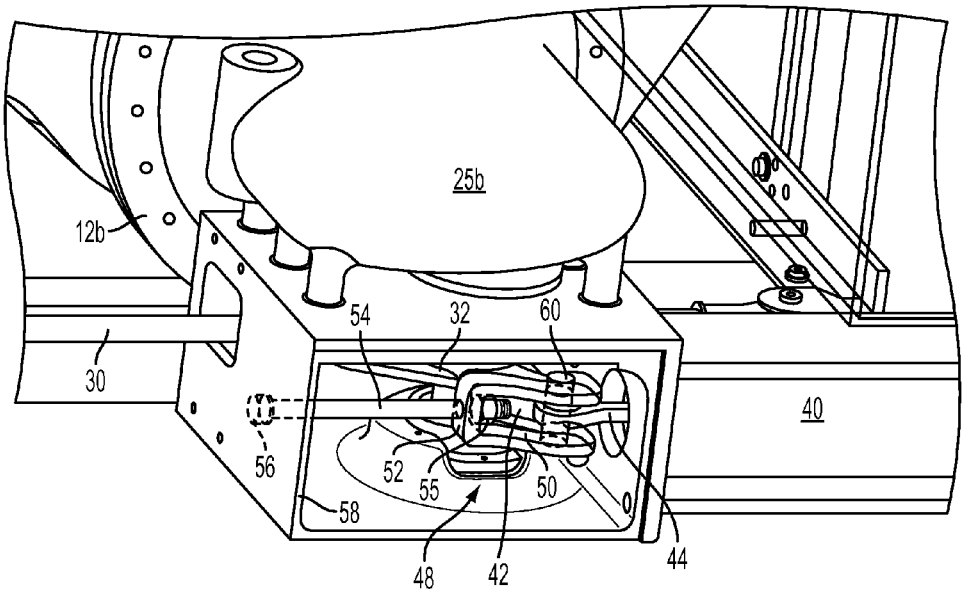
FIG. 4 is a side view of a bell crank coupled to a pole assembly of circuit breaker of FIG. 1, with retaining structure coupled to a portion of the linkage structure of FIG. 3, in accordance with an embodiment.

As noted above, it may be necessary to remove the operating mechanism 29 from the linkage structure 27 for service, such as maintenance or shipping. Prior to removing the operating mechanism 29 and before any factory set spring tension (via springs 46) is removed from the linkage structure 27, retaining structure, generally indicated at 48, is associated with the linkage structure 27 near at least one of the bell crank assemblies, (e.g., assembly 25*c*). With reference to FIG. 4, the retaining structure 48 includes an engaging member 50 associated at one end 52 with a threaded screw 54 and nut 55. The other end 56 of the screw 54 is coupled to a housing 58 for rotation. The engaging member 50 fits over a connection pin 60 that connects the link 44 of the spring structure 40 to the associated lever 32. The screw 54 is rotated in a first direction to tighten the screw 54 into the nut 55 and thus securing the screw with respect to the engaging member 50. The nut 55 can be considered to be part of the engaging member 50 and thus integral therewith. As the screw 54 tightens, the force of the open springs 46 increases but the force is redirected from the levers 32 to the screw 54. With the force off the levers 32, which transmits force to the inter-phase connecting rods 30, one may work on the inter-phase connecting rods 30 safely, or disconnect the connecting rods 30 from the operating mechanism 29 for shipping of the circuit breaker 10.

After servicing is complete, the screw 54 is rotated in a direction opposite the first direction to loosen the screw 54 with respect to the engaging member 50. As the screw 54 loosens, force is slowly redirected from the screw 54 to the levers 32 until the levers take all of the force of springs 46. At that point, the factory pretension setting is back on the linkage structure 27 since no settings were changed during servicing.

Servicing includes maintenance, repair work, shipping, and any other act in which it would be useful to hold pretension. The retaining structure 48 is configured in an appropriate size and of appropriate material for the application.

Although one retaining structure 48 will simultaneously maintain the pretension on all three poles 12*a*, 12*b*, and 12*c*, a retaining structure 48 can be provided at each pole for increased safety at a particular pole being serviced.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. Linkage structure for connection between an operating mechanism and at least one actuating assembly of a circuit breaker for opening and closing an electrical contact of a pole assembly associated with the actuating assembly, the linkage structure comprising:

at least one lever constructed and arranged to connect with the at least one actuating assembly, at least one connection rod coupled to the lever and associate with a close spring for closing the electrical contact, at least one spring structure coupled to the lever, the spring structure including an open spring providing a spring force on the lever for opening the electrical contact, the open spring placing the connection rod in tension, and at least one retaining structure associated with the lever and the spring structure and constructed and arranged to ensure that the spring force of the open spring, exerted on the lever, is directed to the retaining structure so that tension on the connection rod is removed, enabling the connection rod to be serviced.

2. The linkage structure of claim 1, the retaining structure comprises:

an engaging member coupled to the lever, a housing, and a screw having a first end coupled for rotation to the housing and a second end associated with the engaging member, such that as the screw is tightened, the spring force of the open spring directed from the lever to the screw.

3. The linkage structure of claim 2, further comprising a nut, the screw being threadedly engaged with the nut for tightening the screw with respect to the engaging member.

4. The linkage structure of claim 2, wherein the spring structure includes a link having one end coupled to the lever by a connection pin with another end of the link being connected to the open spring.

5. The linkage structure of claim 4, wherein the engaging member is couped to the lever via the connection pin.

6. The linkage structure of claim 1, in combination with the operating mechanism and the actuating assembly.

7. The combination of claim 6, wherein the actuating assembly comprises at least one bell crank assembly coupled to the lever.

8. The combination of claim 7, wherein the circuit breaker is a high voltage, dead tank circuit breaker having three pole assemblies and a bell crank assembly associated with each pole assembly, a lever is coupled with each bell crank assembly and two connection rods are connected between the levers.

9. The combination of claim 8, wherein the open springs, close spring, levers, connection rods, and bell crank assemblies are constructed and arranged to open or close the electrical contact of the poles assemblies simultaneously.

10. A method of maintaining pretension on linkage structure connected between an operating mechanism and at least one actuating assembly of a circuit breaker, the linkage structure including at least one lever constructed and arranged to connect with the at least one actuating assembly for opening and closing a movable electrical contact of a pole assembly associated with the actuating assembly, at least one connection rod coupled to the lever, a close spring associated with the connection rod for closing the electrical contact, and at least one spring structure coupled to the lever, the spring structure including an open spring providing a spring force on the lever for opening the electrical contact, the open spring placing the connection rod in tension, the method comprising the steps of:

associating retaining structure with the lever and the spring structure, adjusting the retaining structure to ensure that the spring force of the open spring, exerted on the lever, is directed to the retaining structure so that tension on the connection rod is removed, enabling the connection rod to be serviced, and after servicing the connection rod, further adjusting the retaining structure to redirect the spring force from the retaining structure back to the lever.

11. The method of claim 10, wherein the step of associating the retaining structure provides the retaining structure to include an engaging member coupled to the lever, a housing, and a screw having a first end coupled for rotation to the housing and a second end associated with the engaging member.

12. The method of claim 11, wherein the screw is threadedly engaged with a nut to secure the screw with respect to the engaging member.

13. The method of claim 12, wherein the adjusting step includes rotating the screw in a first direction so as to tighten the screw with respect to nut and the further adjusting step includes rotating the screw in a direction opposite the first direction to loosen the screw with respect to the nut.

* * * * *